US009289049B2

(12) United States Patent
Kienel et al.

(10) Patent No.: US 9,289,049 B2
(45) Date of Patent: Mar. 22, 2016

(54) APPARATUS FOR CARRYING RECREATIONAL EQUIPMENT

(71) Applicant: One Wave, Inc., Jacksonville, FL (US)

(72) Inventors: Casey Kienel, St. Augustine, FL (US); Brandon Shalton, Jacksonville, FL (US); Christopher Ryan Walrath, Ocala, FL (US); Kirill Semenov, Gainesville, FL (US)

(73) Assignee: One Wave, Inc., Jacksonville, FL (US)

( * ) Notice: Subject to any disclaimer, the term of this patent is extended or adjusted under 35 U.S.C. 154(b) by 159 days.

(21) Appl. No.: 14/250,357

(22) Filed: Apr. 10, 2014

(65) Prior Publication Data

US 2014/0305822 A1 Oct. 16, 2014

Related U.S. Application Data

(60) Provisional application No. 61/810,264, filed on Apr. 10, 2013.

(51) Int. Cl.

| | |
|---|---|
| ***A45F 3/04*** | (2006.01) |
| ***A45F 3/15*** | (2006.01) |
| *B63B 35/79* | (2006.01) |
| *A63C 11/02* | (2006.01) |
| *A45F 3/00* | (2006.01) |

(52) U.S. Cl.

CPC ... *A45F 3/04* (2013.01); *A45F 3/15* (2013.01); *A45F 2003/003* (2013.01); *A63C 11/023* (2013.01); *B63B 35/7946* (2013.01)

(58) Field of Classification Search

CPC ..... A45F 3/04; B63B 35/7946; A63C 11/023

USPC ..... 224/149, 917, 581; 190/107

See application file for complete search history.

(56) References Cited

U.S. PATENT DOCUMENTS

| | | | | |
|---|---|---|---|---|
| 4,515,300 A | | 5/1985 | Cohen | |
| 4,793,535 A | * | 12/1988 | Johnson | 224/329 |
| 5,107,995 A | * | 4/1992 | Simpson | 211/60.1 |
| 5,405,002 A | * | 4/1995 | Troia | 206/315.1 |

(Continued)

FOREIGN PATENT DOCUMENTS

| | | | |
|---|---|---|---|
| DE | 4305180 A1 | * | 8/1994 |
| EP | 611532 B1 | * | 4/1998 |

(Continued)

*Primary Examiner* — Justin Larson

(74) *Attorney, Agent, or Firm* — Maxwell L. Minch; GrayRobinson, P.A.

(57) ABSTRACT

The present invention provides an apparatus and a method to carry recreational equipment on the back of a user, evenly distributing the weight of the recreational equipment on both shoulders of a user. The apparatus comprises of a front container portion, an intermediate portion, and a rear container portion, wherein said intermediate portion is connected between said front container portion and said rear container portion, and said front container portion connects to said rear container portion holding said intermediate portion there between. The intermediate portion comprises of a sleeve to hold a portion of the recreational equipment, at least one intermediate strap to hold an intermediate portion of the recreational equipment, and at least one bottom strap to hold a bottom portion of the recreational equipment. The intermediate portion may be stored between the front container portion and the rear container portion when not in use.

20 Claims, 3 Drawing Sheets

(56) References Cited

U.S. PATENT DOCUMENTS

| | | | | |
|---|---|---|---|---|
| 5,803,332 | A * | 9/1998 | Thompson | 224/651 |
| 5,881,708 | A * | 3/1999 | Kliot | 224/653 |
| 5,893,504 | A * | 4/1999 | Baronian et al. | 224/656 |
| 5,934,533 | A * | 8/1999 | Callanan | 224/651 |
| 5,964,384 | A * | 10/1999 | Young | 224/153 |
| 6,290,114 | B1 * | 9/2001 | Berberian | 224/642 |
| 6,305,587 | B1 * | 10/2001 | Miller | 224/153 |
| 6,536,638 | B1 | 3/2003 | Gulmatico | |
| 7,568,599 | B2 * | 8/2009 | Hall | 224/250 |
| 7,654,426 | B2 * | 2/2010 | Eberle | 224/637 |
| 7,971,764 | B2 * | 7/2011 | Sabbah | 224/650 |
| D720,531 | S * | 1/2015 | Judson et al. | D3/261 |
| 9,010,559 | B2 * | 4/2015 | Boyles | 220/8 |
| 9,049,916 | B2 * | 6/2015 | Berei | |
| 9,074,840 | B2 * | 7/2015 | Andersen | |
| 2003/0042277 | A1 * | 3/2003 | Gulmatico, III | 224/153 |
| 2003/0106920 | A1 * | 6/2003 | Sagan | 224/578 |
| 2005/0236450 | A1 * | 10/2005 | Iannini | 224/577 |
| 2007/0295774 | A1 | 12/2007 | Matschke | |
| 2008/0185409 | A1 | 8/2008 | Kellenberger | |
| 2009/0321481 | A1 | 12/2009 | Licausi | |
| 2010/0006469 | A1 | 1/2010 | Allouche | |
| 2013/0043291 | A1 | 2/2013 | Davis | |
| 2015/0076194 | A1 * | 3/2015 | Sidwa | 224/259 |

FOREIGN PATENT DOCUMENTS

| | | | |
|---|---|---|---|
| FR | 2635693 | A1 * | 3/1990 |
| FR | 2970627 | A1 * | 7/2012 |
| WO | WO 9746135 | A1 * | 12/1997 |

* cited by examiner

APPARATUS FOR CARRYING RECREATIONAL EQUIPMENT

CROSS-REFERENCE TO RELATED APPLICATIONS

The present application claims priority of U.S. Provisional patent application No. 61/810,264 filed on Apr. 10, 2013 the content of which is herein incorporated by reference.

FIELD OF THE INVENTION

The present invention relates to bags for carrying and storage of recreational equipment, and more particularly, to a modifiable and convertible bag for carrying or storing recreational equipment, when not in use, to be carried on the back of a user, evenly distributing the weight upon both shoulders of a user, or alternatively, may be converted or modified to operate as a back pack with or without the carrying or storage of recreational equipment.

BACKGROUND OF THE INVENTION

Board sports such as surfing, skateboarding, snowboarding, snow skiing, kite boarding, and wakeboarding are widely practiced athletic activities. Unfortunately, board sports equipment, such as surf boards, skateboards, snowboards, snow skis, kite boards, and wakeboards, etc., can be cumbersome to transport from place to place, especially in instances where there is any distance from where a participant parks their vehicle and the location where the activity is to be enjoyed.

In this regard, recreational sports equipment carrying apparatus, or bags, are often utilized to transport recreational sports equipment. Recreational sports equipment bags are typically shaped in the general oblong shape of a conventional material. Some recreational sports equipment bags include handles or straps, and others include pockets. As such, the current types of recreational sports equipment bags offered permit basic transportation of recreational sports equipment along with a limited amount of related items. However, there are several drawbacks associated with current recreational sports equipment bag designs.

One such drawback is that current recreational equipment carrying bags require the sports equipment to be carried and transported under the user's arm, over the head, or strapped over one shoulder (see for instance US2010/0006469 A1 and U.S. Pat. No. 6,536,638 B1). These bags cause unneeded stress on a user's shoulder, requiring a user to frequently change how they are carrying a board to and from its use. Where there is any distance between a user's parked vehicle and the area for the recreational activity, conventional methods are thus inadequate in this respect. Some equipment storage bags have attempted a solution where the recreational equipment is carried using two shoulder straps, similar to that of a back pack, however these solutions are complicated, are not user friendly, and in some instances don't allow for the free use of a user's arms during transport (see for instance US2013/0043291 A1 and US 2008/0185409 A1).

Another drawback is that conventional recreational equipment carrying apparatus are only designed for a single use, to carry only the board they were designed. When not in use, these bags have no other utility for other recreational activities, or as simply a back pack for carrying smaller items. Conventional recreational equipment carriers are often large and bulky so that they are difficult to use, and when not in use cannot be easily stored, thus their limited use and unease of storage makes them undesirable and obsolete.

Another drawback with current recreational equipment carrying apparatus do not adequately accommodate all shapes and/or sizes of recreational equipment. Accordingly, recreational equipment which does not fit into the storage apparatus will leave excess room, or slack, in the larger sized bag, which undesirably permits the board to move freely within the storage apparatus and potentially become damaged, and create an added burden on the user carrying the device as the contents in the bag shift. It would therefore be beneficial to provide a recreational equipment carrier which has the ability to be modified to adapt to variety of recreational equipment shapes and/or sizes.

Another issue with current recreational equipment carriers is that few have pockets to store other items. Some do allow storage of smaller items such as wallets, keys, phones), and even fewer have the storage capacity to store larger necessary items such as clothing, shoes, flip flops, towels, books, etc. Those that do accommodate these larger items usually cannot carry these items while carrying the recreational equipment, thus frustrating the purpose of an all-inclusive storage apparatus for a recreational sporting event. Moreover, the few devices which include pockets do not incorporate materials to isolate dampness or wetness, thus allowing moisture from inside of the bag to seep out to the exterior of the bag and come into unwanted contact with other items. Likewise, such bags also allow wetness from outside of the bag to seep into the bag. Accordingly, it would be desirable to provide a recreational equipment bag with adequate storage capacity for other items while substantially preventing seepage of wetness from the interior of the case to the exterior of the case, or vice versa.

No such recreational equipment storage apparatus has been presented to date to address these issues.

SUMMARY OF INVENTION

The present invention provides an apparatus for carrying recreational equipment which is comprised of a front container portion which has at least two straps so that the front container portion may be worn on the back of a user. The apparatus is also comprised of an intermediate portion and a rear container portion. The intermediate portion is for carrying the recreational storage equipment, and is affixed to both the front container portion and the rear container portion. The intermediate may be permanently fixed (either by stitching, sewing, or some other connection technique) to the front and rear container portions, or may be removably fixed (through the use of separable connection methods such as zippers or Velcro). In addition, when the intermediate portion is not in use, it may be bundled and stored internally between the front and rear container portions, or may alternately be removed.

In one embodiment the intermediate portion is a sleeve for holding a portion of the recreational equipment, at least one intermediate adjustable strap for holding an intermediate portion of the recreational equipment, and at least one bottom strap for holding a bottom portion of the recreational equipment. In one embodiment the intermediate portion further includes a nose cap and nose cap adjustable strap.

Alternatively, the present invention may include additional straps which connect the rear container portion to the front container portion providing added support for carrying the recreational equipment being carried in the intermediate portion, and the shoulder straps may also include a horizontal strap, either across the stomach or chest of a user, to prevent the shoulder harness from slipping off a user.

In an alternative embodiment the front container portion or the rear container portion may have more than one pocket for carrying items. Preferably, the front container portion has smaller pockets for carrying items such as keys, wallets or phones, which may be easily accessible to a user while using the apparatus to carry storage equipment. The rear container portion preferably includes larger pockets for carrying larger items such as garments, books, towels, swimming equipment, or the like. Where the apparatus makes use of storage pockets, the front and rear container portions include a liner made of waterproof material isolating moisture to the intermediate portion, and isolating exterior moisture (such as rain) from permeating through to the internals of the pockets.

In an alternative embodiment the intermediate portion is removably attached to both the front and rear container portions allowing complete removal of the intermediate portion from the apparatus. When removed, the front and rear container portion may still be adjoined to each other allowing the use of the storage apparatus as a conventional back pack. Optionally, different sized intermediate portions may be attached between both the front and rear container portions, each intermediate portion sized for the particular recreational equipment it is intended to carry.

DETAILED DESCRIPTION OF THE INVENTION

The following detailed description is merely exemplary in nature and is in no way intended to limit the scope of the invention, its application, or uses, which may vary. The invention is described with relation to the non-limiting definitions and terminology included herein. These definitions and terminology are not designed to function as a limitation on the scope or practice of the invention, but are presented for illustrative and descriptive purposes only.

Various terms used throughout the specification and claims are defined as set forth below as it may be helpful to an understanding of the invention.

As used herein, "recreational sports equipment" shall mean any apparatus or tool used for the performance of a recreational activity, preferable some type of board or oblong shape. Recreational sports equipment shall include surfboards, kite boards, wake boards, skateboards, snowboards, snow skis, and the like.

As used herein, "conventional materials" shall mean those material which are known in the art for making bags, backpacks, or other carrying devices including fabric, terrycloth, neoprene, vinyl, rayon, recycled material, bamboo, acrylic or spandex.

As used herein "waterproof material" shall mean those materials which are known in the art for making waterproof or water resistant items, especially those materials which are typically used in the construction of waterproof or water resistant bags, specifically those materials or fabrics that can be heat sealed, that have little to no pores, or that are otherwise plastics.

As used herein "recreational material items" shall mean those items that may be used in the performance of a recreational sport that normally accompany the use of the recreational equipment being carried by the apparatus. These items include goggles, gloves, helmets, boots, hats and the like.

The present invention contains the features of the recreational equipment storage and carrying apparatus as herein described.

Recreational Equipment Carrying Apparatus

Figure 1:
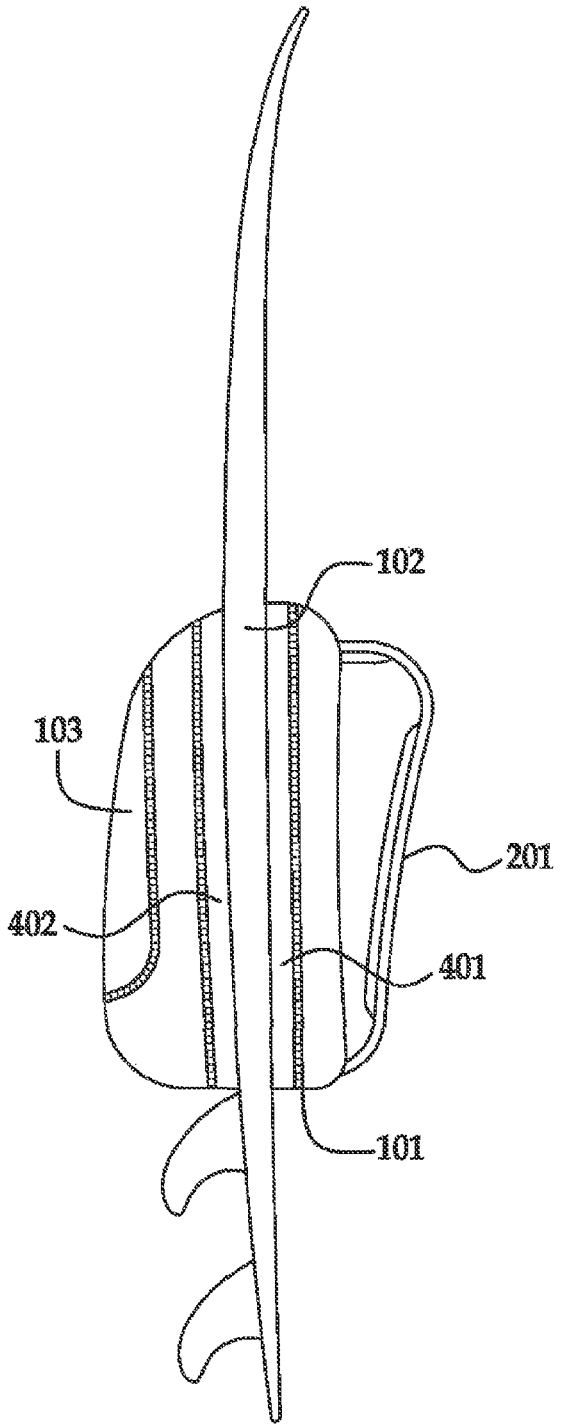
FIG. 1 is a cross-sectional view of the recreational equipment carrying apparatus made for the use of carrying a 202 surfboard and illustrating the interrelationship of the 101 front container portion, 102 intermediate portion and 103 rear container portion, as well as the 401, 402 zippers for storing the 102 intermediate portion within the 101 front container portion and 102 rear container portion when the 102 intermediate portion is no in use, or optionally when the 102 intermediate portion has been removed. The 401, 402 zippers are not used while the 102 intermediate portion is connected and storing equipment.

The present invention provides a recreational equipment carrying apparatus which may also be converted for use as a backpack. The apparatus is comprised of 101 a front container portion, an 102 intermediate portion and a 103 rear container portion. FIG. 1 illustrates the recreational equipment carrying apparatus made for the use of carrying a surfboard and illustrating the interrelationship of the 101 front container portion, 102 intermediate portion and 103 rear container portion. In one embodiment the 102 intermediate portion is affixed using conventional means to both the 101 front container portion and the 103 rear container portion. When in use for carrying recreational equipment, the 102 intermediate portion performs the function of containing the 202 recreational equipment. When the 102 intermediate portion is not being used to carry 202 recreational sports equipment, it may be stowed between the 101 front container portion and the 103 rear container portion, where the 101 front container portion and the 103 rear container portion are then attached together using a means for attachment, such as 401, 402 zippers, converting the carrying apparatus to a conventional back pack. In one embodiment, the 101 front container portion and the 103 rear container portion include straps which connect to each other outside of the 102 intermediate portion, providing additional support holding the apparatus together. It should be appreciated that while FIG. 1 illustrates the use of the carrying apparatus for a surfboard, the apparatus may be used for any recreational equipment.

Front Container Portion

Figure 2:
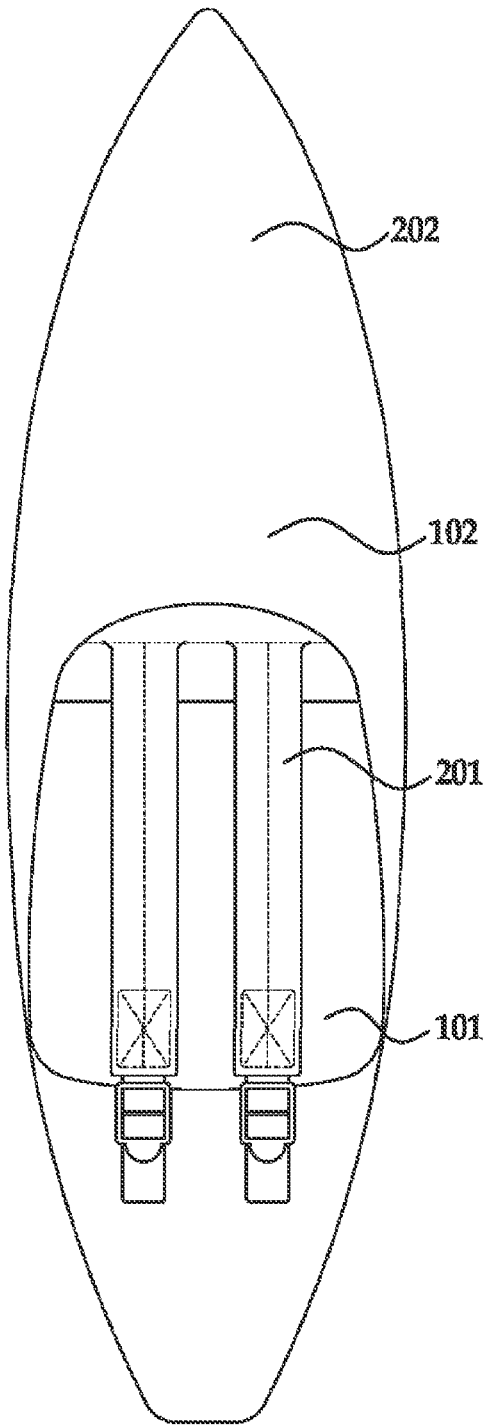
FIG. 2 is a direct view of the 101 front container portion of the recreational equipment carrying apparatus, while connected to the 102 intermediate portion, made for the use of carrying a 202 surfboard and illustrating the interrelationship of the 201 two or more carrying straps allowing the 101 front container portion to be worn on the back of a user.

The 101 front container portion has a front side and a rear side and may be constructed of any conventional or waterproof materials. FIG. 2 illustrates the 101 front container portion of the recreational equipment carrying apparatus, while connected to the 102 intermediate portion. The rear side of the front container portion is connected to the 102 intermediate portion, or may be connected to the front side of the rear container portion when the 102 intermediate portion is stowed or removed. The front side of the front container portion has two or more 201 carrying straps forming a harness which may be worn on the back of a user. In one embodiment, the carrying straps have an additional strap which connects the two carrying straps to one another preventing the harness from inadvertently slipping off a user's shoulders. The additional strap may be connected across the chest or the stomach of the user.

In one embodiment, the rear side of the 101 front container portion comprises of a waterproof liner which separates the 102 intermediate portion from the 101 front container portion, thus preventing moisture residue from permeating to the 101 front container portion.

In one embodiment, the 101 front container portion further comprises of at least one pocket. The pockets can be of any size, however in a preferred embodiment the pockets of the 101 front container portion would be made suitable for carrying keys, cell phones, wallets, or other small items that a user would desire immediate access to. In one embodiment, the 101 front container portion optionally includes a storage pocket for a laptop computer or tablet, which may optionally be located on the 103 rear container portion.

Rear Container Portion

Figure 3:
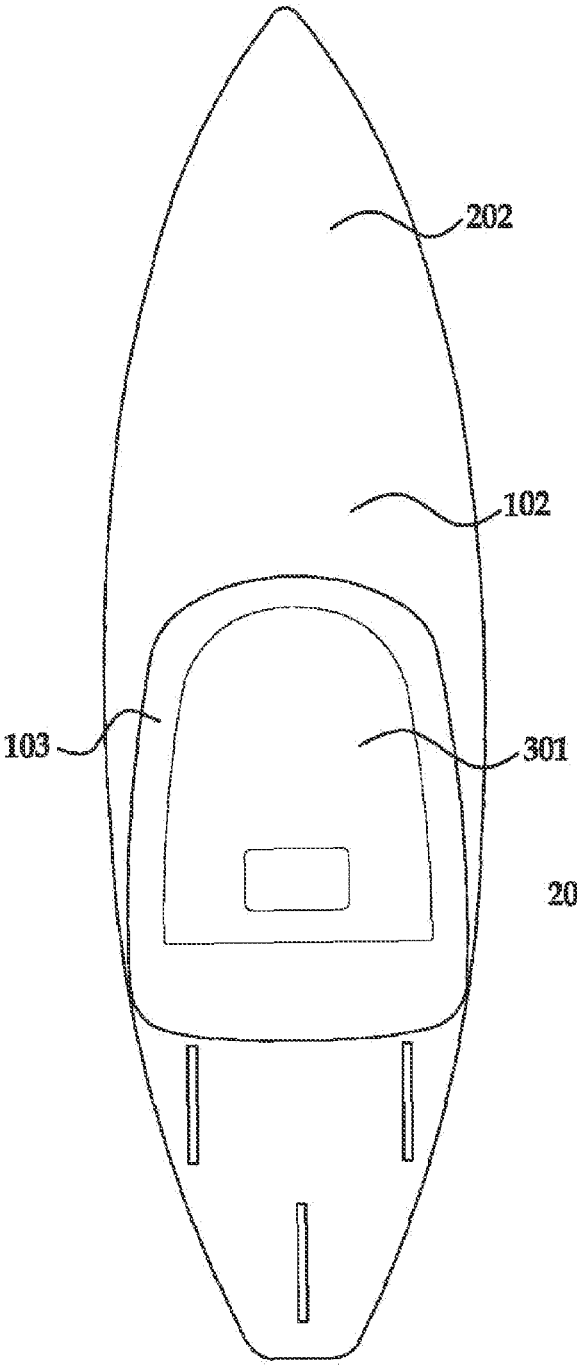
FIG. 3 is a direct view of the 103 rear container portion of the recreational equipment carrying apparatus, while connected to the 102 intermediate portion, made for the use of carrying a 202 surfboard and illustrating the interrelationship of the optional 301 pockets for storage of recreational materials.

The 103 rear container portion has a front side and a rear side and may be constructed of any conventional or waterproof materials. FIG. 3 illustrates the 103 rear container portion of the recreational equipment carrying apparatus, while connected to the 102 intermediate portion. The front side of the rear container portion is connected to the 102 intermediate container portion, or may be connected to the front side of the rear container portion when the 102 intermediate portion is stowed or removed. In one embodiment, the front side of the 103 rear container portion comprises of a waterproof liner which separates the 102 intermediate portion from the 103 rear container portion, thus preventing moisture residue from the recreational equipment from permeating to the 103 rear container portion.

In one embodiment, the 103 rear container portion further comprises of 301 at least one pocket. The 301 pockets can be of any size, however in a preferred embodiment the 301 pockets of the 103 rear container portion would be made suitable for carrying books, clothing items, shoes, towels, other recreational material items, or the like, or preferably larger items that a user will not likely need until participating in the recreational sport. In at least one embodiment multiple 301 pockets are incorporated.

Intermediate Portion

The 102 intermediate portion is illustrated in FIGS. 1-3 made for the use of carrying a surfboard. The intermediate portion may be permanently connected to the 101 front container portion and the 103 rear container portion through conventional connection means (such as stitching, sewing, stapling and the like), or may be removably connected through conventional removable connection means (such as a zipper or Velcro). The 102 intermediate portion is connected to the rear side of the 101 front container portion and the front side of the 103 rear container at a location well within the 101 front container portion and the 103 rear container portion 401, 402 attachment means, such as zippers, such that the 102 intermediate portion may be completely stowed between the 101 front container portion and the 103 rear container portion allowing for the attachment means 401, 402 to be closed without obstruction, while containing the entire 102 intermediate portion.

Figure 4:
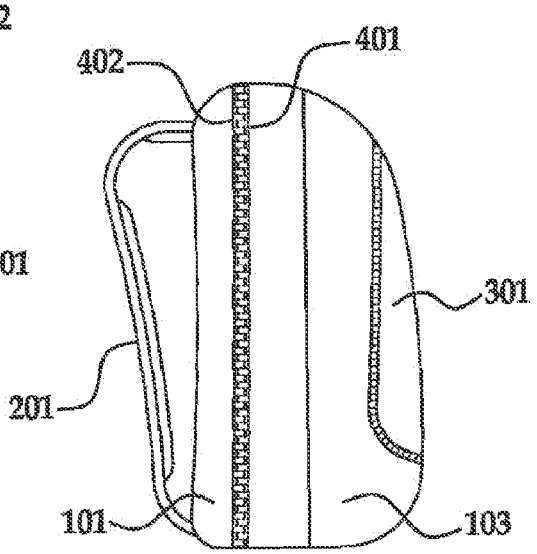
FIG. 4 is a cross-sectional view of the recreational equipment carrying apparatus while either the 102 intermediate portion is stored between the 101 front container portion and 103 rear container portion, or optionally removed, illustrating the interrelationship of the 101 front container portion and 103 rear container portion, as well as the 401, 402 zippers while being used in this configuration.

In one embodiment, the 102 intermediate portion is optionally removable, allowing for other 102 intermediate portions, which have been fashioned to hold other recreational sports equipment, to be connected to the apparatus. In the alternative, a removable 102 intermediate portion may be removed and used as a blanket, or removed altogether if a user desires to connect the 101 front container portion and the 103 rear container portions only, thus using the apparatus as a conventional back pack. FIG. 4 illustrates the 202 recreational equipment carrying apparatus while either the 102 intermediate portion is stored between the 101 front container portion and 103 rear container portion, or optionally removed, illustrating the interrelationship of the 101 front container portion and 103 rear container portion, as well as the 401, 402 attachment means while being used in either the fixed or removable 102 intermediate portion configuration.

Figure 5:
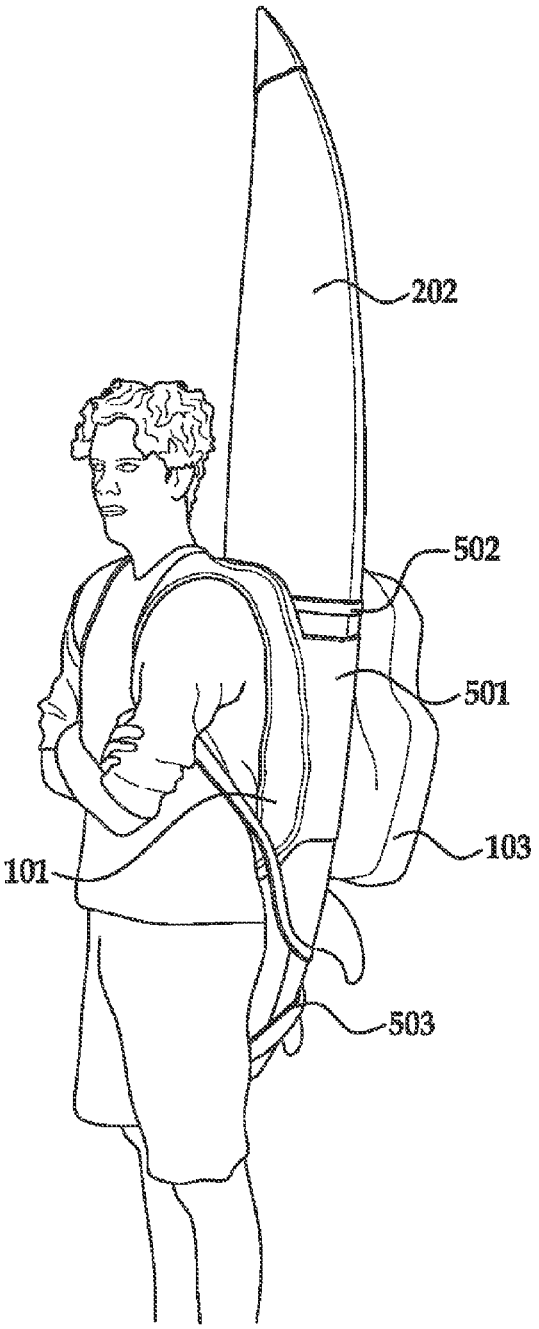
FIG. 5 is a side profile view illustrating the use of the recreational equipment carrying apparatus wherein the 102 intermediate portion is a 501 sleeve, a 502 intermediate adjustable strap and a 503 bottom adjustable strap.

FIG. 5 illustrates one embodiment of the inventive apparatus wherein the 102 intermediate portion is a 501 sleeve for holding a portion of the 202 recreational sports equipment, at least one 502 intermediate adjustable strap for holding an intermediate portion of the 202 recreational equipment, and at least one 503 bottom strap for holding a bottom portion of the 202 recreational equipment. The 502 intermediate adjustable strap is tightened to hold the 202 recreational sports equipment between the 101 front container portion and the 103 rear container portion. In one embodiment the 503 bottom strap is used to apply an upward force on the bottom of the 202 recreational sports equipment. In one embodiment the 503 bottom strap applies an upward force on the bottom of the 202 recreational equipment by holding at least one fin on said 202 recreational equipment. In at least one embodiment the 501 sleeve is made from an elastic material such as elastic or neoprene. In at least one embodiment the 501 sleeve is made from a combination of one or more materials in combination with elastane. In at least one embodiment the 501 sleeve is made from a material that has no elastic properties, or with material that has similar stretch properties as elastic.

Figure 6:
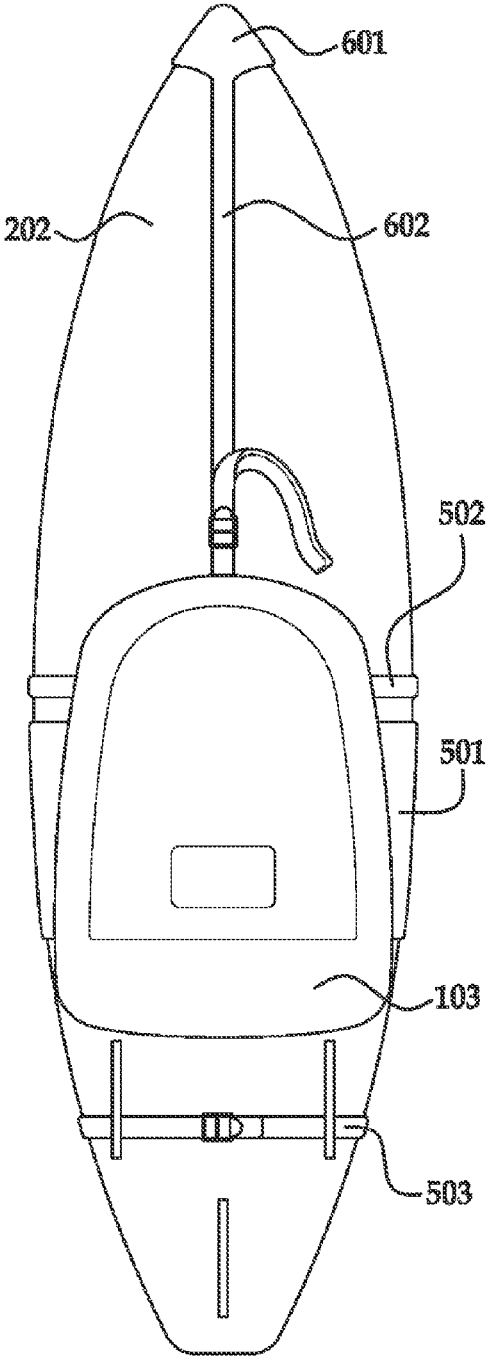
FIG. 6 is a back view of a user illustrating the use of the recreational equipment apparatus wherein the 102 intermediate portion a 501 sleeve, a 502 intermediate adjustable strap, a 503 bottom adjustable strap, a 601 nose cap and a 602 nose cap adjustable strap.

In at least one embodiment, a 601 nose cap and a 602 nose cap adjustable strap is used to hold the 202 to the apparatus. FIG. 6 is illustrative of at least one embodiment wherein the 102 intermediate portion is a 501 sleeve for holding a portion of the 202 recreational sports equipment, at least one 502 intermediate adjustable strap for holding an intermediate portion of the 202 recreational equipment, at least one 503 bottom strap for holding a bottom portion of the 202 recreational equipment, and a 601 nose cap and a 602 nose cap adjustable strap for holding a top portion of the 202 recreational equipment. In one embodiment the 601 nose cap is placed on the top end of the 202 recreational equipment and the 602 nose cap adjustable strap is connected to the 601 nose cap and longitudinally connects to said 502 intermediate adjustable strap or within said 102 intermediate portion.

The drawings and diagrams shown herein depict example arrangements of elements of the apparatus and method. More or less than all the features available or contemplated may be present in an actual embodiment. It should also be understood that FIGS. 1-4 are merely illustrative and may not be drawn to scale.

EXAMPLES

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

Example 1

An apparatus is used comprising of a rear container portion an intermediate portion and a rear container portion. The intermediate portion has a sleeve made of an elastomeric material which holds a portion of the surfboard snugly within the sleeve. The user inserts the surfboard into the sleeve, tightens an adjustable strap to hold an intermediate portion of the surfboard, and tightens an adjustable strap is placed to hold at least one fin of the surfboard which holds the bottom end of the surfboard to the intermediate portion. The user then inserts a change of clothing, towels, and flip flops into a pocket of the rear container portion, and puts on the harness of the front container portion, thus wearing the apparatus containing the surfboard on his back. When the user reaches the desired location, the user removes the surfboard, tucks the intermediate portion between the front container portion and the rear container portion, and closes the apparatus using the zippers for connecting the front container portion and the rear container portion.

Example 2

An apparatus is used comprising of a rear container portion an intermediate portion and a rear container portion. The intermediate portion is fashioned to fit a shortboard surfboard having a length between six (6) feet, four (4) inches and six (6) feet, ten (10) inches. The user inserts the surfboard into the intermediate portion and closes the intermediate portion using a pull string located at the bottom of the intermediate portion. The user then inserts a change of clothing, towels, and flip flops into a pocket of the rear container portion, and puts on the harness of the front container portion, thus wearing the apparatus containing the surfboard on his back. When the user reaches the desired location, the user removes the surfboard, tucks the intermediate portion between the front container portion and the rear container portion, and closes the apparatus using the zippers for connecting the front container portion and the rear container portion.

Example 3

A user uses the apparatus as exemplified in Example 1, however the apparatus contains a removable intermediate portion. When the user reaches the desired location for surfing, the intermediate portion is removed and used as a blanket thus allowing the user a place to store their items and sit without getting covered with beach sand.

Example 4

An apparatus is used comprising of a rear container portion a removable intermediate portion and a rear container portion. The installed intermediate portion is fashioned to fit a shortboard surfboard having a length between six (6) feet, four (4) inches and six (6) feet, ten (10) inches, but the user desires to use the apparatus to carry a snowboard. The user removes the intermediate portion fashioned for the surfboard, and replaces it with an intermediate portion fashioned to snugly hold a freestyle snow board. The user inserts the snowboard into the intermediate portion and closes the intermediate portion using a zipper located at the bottom of the intermediate portion. The user then inserts a goggles, snowboard boots, and lunch into the pocket of the rear container portion, and puts on the harness of the front container portion, thus wearing the apparatus containing the snowboard on his back. When the user reaches the desired location, the user removes the snowboard, tucks the intermediate portion between the front container portion and the rear container portion, and closes the apparatus using the zippers for connecting the front container portion and the rear container portion. The user then wears the apparatus as a backpack while snowboarding.

Other Embodiments

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

The invention claimed is:

1. An apparatus for carrying recreational equipment, the apparatus comprising: a front container portion; an equipment carrying intermediate portion; and a rear container portion; wherein said front container portion connects to said intermediate portion, said intermediate portion connects to said rear container portion, when said intermediate portion is being used to carry recreational equipment said front container portion is disconnected from said rear container portion to allow recreational equipment to be held within said intermediate portion and extend above and below said apparatus, and when said intermediate portion is not being used to carry recreational equipment said front container portion connects to said rear container with said intermediate portion stowed internally between said front container portion and said rear container portion.

2. The apparatus of claim 1 wherein said front container portion further comprises two or more carrying straps allowing said front container portion to be worn on the back of a user.

3. The apparatus of claim 2 further comprising a horizontal strap connecting said two or more carrying straps.

4. The apparatus of claim 1 wherein said front container portion further comprises a liner made of waterproof material, said liner located where said front container connects to said intermediate portion, thereby preventing moisture transfer between said intermediate portion and said front container portion.

5. The apparatus of claim 1 wherein said front container portion has one or more storage pockets.

6. The apparatus of claim 1 wherein said intermediate portion comprises a sleeve for holding a portion of the recreational equipment, at least one intermediate adjustable strap for holding an intermediate portion of the recreational equipment, and at least one bottom strap for holding a bottom portion of the recreational equipment.

7. The apparatus of claim 6 wherein said intermediate adjustable strap is positioned near said sleeve.

8. The apparatus of claim 6 further comprising a nose cap and a nose cap adjustable strap, wherein said nose cap is placed on the top end of the recreational equipment and said nose cap adjustable strap is connected to the nose cap and longitudinally connects to said intermediate strap or within said intermediate portion.

9. The apparatus of claim 1 wherein said intermediate portion is an elongated bag for carrying recreational equipment, the bag having a top end and a bottom end, said bag shaped to accommodate the shape of the recreational equipment, and said top end or said bottom end of said elongated bag having a closeable opening to contain the recreational equipment within the elongated bag.

10. The apparatus of claim 1 wherein said intermediate portion is removably attached to said front container portion and said rear container portion, wherein said intermediate portion may be completely removed while said front container portion may be attached to said rear container portion without said intermediate portion.

11. The apparatus of claim 1 wherein said rear portion comprises of one or more pockets.

12. The apparatus of claim 1 wherein said rear portion further comprises a liner made of waterproof material, said liner located where said rear container connects to said intermediate portion, thereby preventing moisture transfer between said intermediate portion and said rear container portion.

13. An apparatus for carrying recreational equipment, the apparatus comprising: a front container portion having two or more carrying straps allowing said front container portion to be worn on the back of a user; an intermediate portion wherein said intermediate portion comprising a sleeve for holding a portion of the recreational equipment, at least one intermediate adjustable strap for holding an intermediate portion of the recreational equipment, and at least one bottom strap for holding a bottom portion of the recreational equipment; and a rear container portion; wherein said front container portion connects to said intermediate portion, said intermediate portion connects to said rear container portion, and said front container portion connects to said rear container portion holding said intermediate portion there between; and wherein when said intermediate portion is being used to carry recreational equipment, said front container portion is disconnected from said rear container portion to allow recreational equipment to be held within said intermediate portion and extend above and below said apparatus.

14. The apparatus of claim 13 further comprising a nose cap and a nose cap adjustable strap, wherein said nose cap is placed on the top end of the recreational equipment and said nose cap adjustable strap is connected to the nose cap and longitudinally connects to said intermediate strap or within said intermediate portion.

15. The apparatus of claim 13 wherein said front container portion further comprises a liner made of waterproof material, said liner located where said front container connects to said intermediate portion, thereby preventing moisture transfer between said intermediate portion and said front container portion.

16. The apparatus of claim 13 wherein said front container portion has one or more storage pockets.

17. The apparatus of claim 13 wherein said intermediate portion is removably attached to said front container portion and said rear container portion, wherein said intermediate portion may be completely removed while said front container portion may be attached to said rear container portion without said intermediate portion.

18. The apparatus of claim 13 wherein said rear portion comprises of one or more pockets.

19. The apparatus of claim 13 wherein said rear portion further comprises a liner made of waterproof material, said liner located where said rear container connects to said intermediate portion, thereby preventing moisture transfer between said intermediate portion and said rear container portion.

20. A method for using the apparatus of claim 13, the method comprising: separating the front container portion from the rear container portion, exposing an intermediate portion; inserting recreational equipment into said intermediate portion; connecting at least one adjustable strap to hold recreational equipment within said intermediate portion; and carrying said front container portion by said two or more carrying straps on the back of a user, thereby carrying the recreational equipment on the back of a user.

* * * * *